US007866811B2

(12) United States Patent
Sen et al.

(10) Patent No.: US 7,866,811 B2
(45) Date of Patent: Jan. 11, 2011

(54) PRINT MEDIA

(75) Inventors: Radha Sen, San Diego, CA (US); Robert Beer, Ilford Imaging (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 1154 days.

(21) Appl. No.: 11/044,577

(22) Filed: Jan. 27, 2005

(65) Prior Publication Data

US 2006/0078695 A1 Apr. 13, 2006

Related U.S. Application Data

(60) Provisional application No. 60/618,256, filed on Oct. 13, 2004.

(51) Int. Cl.
*B41J 2/01* (2006.01)

(52) U.S. Cl. ..... 347/105; 347/101; 428/32.1

(58) Field of Classification Search ..... 347/101, 347/105; 428/195, 32.1
See application file for complete search history.

(56) References Cited

U.S. PATENT DOCUMENTS 6,472,053 B1 * 10/2002 Hoshino et al. ..... 428/32.34
6,838,137 B2 1/2005 Liu et al.
2004/0224104 A1 * 11/2004 de Vries et al. ..... 428/32.18
2005/0003112 A1 * 1/2005 Chen ..... 428/32.11

FOREIGN PATENT DOCUMENTS

| | | |
|---|---|---|
| EP | 0 633 508 A | 1/1995 |
| EP | 1 080 937 A | 3/2001 |
| EP | 1 228 889 A | 8/2002 |
| EP | 1 228 891 A | 8/2002 |
| JP | 7-137435 | 5/1995 |
| JP | 10-44586 | 2/1998 |
| JP | 200110215 | 1/2001 |
| JP | 2001-96905 | 4/2001 |
| JP | 2002-234246 | 8/2002 |
| JP | 2003-170659 | 6/2003 |

* cited by examiner

*Primary Examiner*—Manish S Shah

(57) ABSTRACT

Print media and systems for preparing a fused ink-jet image are disclosed. One exemplary print medium, among others, includes a substrate, a porous ink-receiving layer disposed on the substrate, and a porous surface layer disposed on the porous ink-receiving layer. The porous surface layer includes polymer particles and a non-ionic stabilizing surfactant.

11 Claims, 2 Drawing Sheets

PRINT MEDIA

CROSS-REFERENCE TO RELATED APPLICATION

This application claims priority to copending U.S. provisional patent application entitled "Print Media" filed on Oct. 13, 2004 and accorded Ser. No. 60/618,256, which is entirely incorporated herein by reference.

BACKGROUND

The use of inkjet printing in offices and homes has grown dramatically in recent years. The growth can be attributed to drastic reductions in cost of inkjet printers and substantial improvements in print resolution and overall print quality. While the print quality has improved drastically, research and development efforts continue toward further improving the print quality to achieve images having photographic quality. A photographic quality image includes saturated colors, high gloss and gloss uniformity, freedom of grain and coalescence, and a high degree of permanence. To achieve photographic image quality, the print medium must be fast drying and resist smearing, air, light, and moisture. In addition, the print medium should provide good color fidelity and high image resolution.

Print media that are capable of producing images having photographic image quality are typically categorized into two groups: porous media and swellable media. Porous media generally have an ink-receiving layer that is formed from porous, inorganic particles bound with a polymer binder. An ink-jet ink is absorbed into the pores of the inorganic particles and the colorant is fixed by mordants incorporated in the ink-receiving layer or by the surface of the inorganic particles.

In swellable media, the ink-receiving layer is a continuous layer of a swellable, polymer matrix. When the inkjet ink is applied, the inkjet ink is absorbed by swelling of the polymer matrix and the colorant is immobilized inside the continuous layer.

SUMMARY

Briefly described, embodiments of this disclosure include print media and systems for preparing a fused ink-jet image. One exemplary print medium, among others, includes a substrate, a porous ink-receiving layer disposed on the substrate, and a porous surface layer disposed on the porous ink-receiving layer. The porous surface layer includes polymer particles and a non-ionic stabilizing surfactant.

One exemplary system, among others, includes: a print medium, an ink dispensing system configured to print ink onto the print medium, and a fuser system configured to fuse the print media after dispensing ink onto the print medium. The print medium includes a substrate, a porous ink-receiving layer disposed on the substrate, and a porous surface layer disposed on the porous ink-receiving layer. The porous surface layer includes polymer particles and a non-ionic stabilizing surfactant.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Print media and systems using print media are described. Briefly, the print medium can include, but is not limited to, a substrate having ink-receiving layer and a porous surface layer. The porous surface layer can include, but is not limited to, a plurality of polymer beads, a non-ionic stabilizing surfactant, and a binder. After disposing the ink (e.g., pigment-based inkjet inks and/or dye-based inkjet inks) onto the porous surface layer, the print medium is fused.

Previous print media using more than one porous layer generated using single pass wet on wet coating have disadvantages. Although not intending to be bound by theory, small molecules that are not anchored to a large species move freely throughout the multiple porous layers. The binders do not move as freely, but move closer to the layers surface during the water removal processes. Migration of the binder closer to the surface leads to a reduction of addressable capacity by clogging the pores of surface coating. Therefore, printing on the media leads to pooling, puddling, and coalescence, which is not observed when the surface layer is not present. However, incorporation of selected non-ionic stabilizing surfactants into the porous surface layer opens up the pores of the surface layer, thereby allowing the ink to penetrate. The non-ionic stabilizing surfactants that allow this behavior to occur are those that associate (e.g., absorbed onto the polymer bead surface) with the polymer beads as confirmed using surface tension measurements. Surfactants that do not associate with the polymer beads do not improve the porosity of the surface layer. Therefore, when the non-ionic stabilizing surfactant is adsorbed onto the surface of the polymer beads, a steric barrier is formed that physically keeps the polymer beads separated and increases the porosity.

Figure 1:
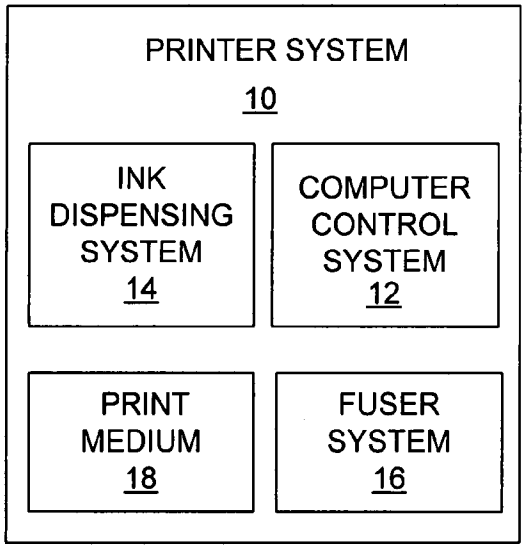
FIG. 1 illustrates an embodiment of a printer system.

FIG. 1 illustrates a block diagram of a representative printer system 10 that includes a computer control system 12, ink dispensing system 14, fuser system 16 and a print medium 18. The computer control system 12 includes a process control system that is operative to control the ink dispensing system 14 and the fuser system 16. In particular, the computer control system 12 instructs and controls the ink dispensing system 14 to print characters, symbols, photos, and the like, onto the print medium 18. In addition, the computer control system 12 instructs and controls the fuser system 16 to fuse the print medium 18 after printing.

The ink dispensing system 14 includes, but is not limited to, ink-jet technologies and coating technologies, which dispense the ink onto the print medium. Ink-jet technology, such as drop-on-demand and continuous flow ink-jet technologies, can be used to dispense the ink. The ink dispensing system 14 can include at least one ink-jet printhead (e.g., thermal ink-jet printhead and/or a piezo ink-jet print head) operative to dispense (e.g., jet) the inks through one or more of a plurality of ink-jet printhead dispensers.

Figure 2:
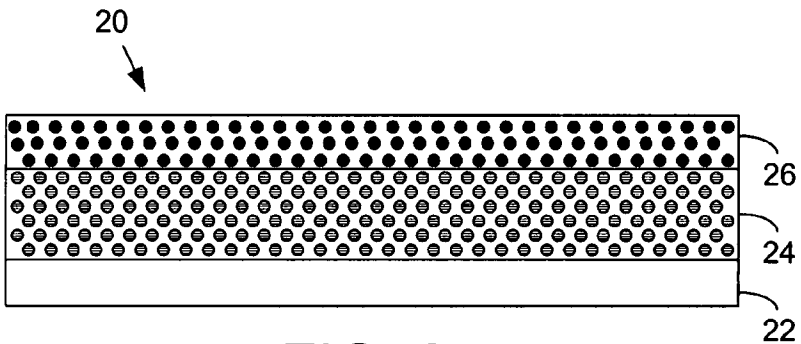
FIG. 2 illustrates a cross-sectional view of a representative embodiment of print medium having an ink-receiving layer and a porous surface layer.

FIG. 2 illustrates a cross-sectional view of a representative embodiment of the print medium 30. As mentioned above, the print medium 30 can include, but is not limited to, a substrate 22 having ink-receiving layer 24 and a porous surface layer 26. The ink-receiving layer 24 is disposed on the substrate 22, while the porous surface layer 26 is disposed on the ink-receiving layer 24. The ink-receiving layer 24 can include, but is not limited to, microporous, inorganic particles and a binder. The porous surface layer 26 can include, but is not limited to, a polymer particles, a swellable binder, and a non-ionic stabilizing surfactant.

The term "substrate" 22 refers to print medium substrates that can be coated with the ink-receiving layer 24 in accordance with embodiments of the present disclosure. The substrate 22 can include, but is not limited to, paper substrates, photobase substrates, plastic substrates such as clear to opaque plastic film, and the like. The substrate 22 may include, but is not limited to, a hard or flexible material made from a polymer, a paper, a glass, a ceramic, a woven cloth, or a non-woven cloth material.

The term "ink-receiving layer" 24 refers to a layer that includes microporous, inorganic particles that can be disposed (e.g., coated) on the substrate 32. The ink-receiving layer 24 is configured to receive ink within the pores provided by the microporous, inorganic particles. The ink-receiving layer 24 can be from about 10 to 30 grams per square meter (GSM) and from about 25 to 30 GSM.

As mentioned above, the ink-receiving layer 24 includes microporous, inorganic particles. The microporous, inorganic particles can include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boehmite, bentonite, hectorite, clay, and mixtures thereof.

In addition, the ink-receiving layer 24 also includes a binder used to bind the microporous, inorganic particles. The binder can include, but is not limited to, water soluble polymers (e.g., polyvinyl alcohol, cationic polyvinylalcohol, acetoacetylated polyvinylalcohol, silylated polyvinylalcohol, carboxylated polyvinylalcohol, polyvinylpyrrolidone, copolymer of polyvinylacetate and polyvinylpyrrolidone, copolymer of polyvinylalcohol and polyvinylpyrrolidone, cationic polyvinylpyrrolidone, gelain, hydroxyethylcellulose, methyl cellulose), water dispersible polymers, gelatin, and combinations thereof.

An amount of binder can be used that functionally binds together the microporous, inorganic particles, but still leaves space between and within the microporous, inorganic particles such that ink can be received within the ink-receiving layer 24 upon printing. Appropriate ratios can provide ink-receiving layers that avoid unwanted cracking upon drying, and at the same time, provide microporous, inorganic particle to microporous, inorganic particle adhesion within the ink-receiving layer 24 while maintaining voids within and around the microporous, inorganic particles. For example, the ink-receiving layer 24 can include greater than about 80% inorganic particles.

The term "porous surface layer" 26 refers to a layer that includes a polymer particles, a swellable binder, and a non-ionic stabilizing surfactant, that can be disposed (e.g., coated) on the ink-receiving layer 24. The porous surface layer 26 is from about 1 to 3 grams per square meter.

As used herein, the term "polymer particles" refers to a plastic particle that does not include pores or voids. The polymer particle may have an average particle size ranging from about 100 nanometers (nm) to 300 nm.

Examples of polymer particles include, but are not limited to, synthetic latexes such as acrylic, styrene acrylic, ethylene vinylacetate, vinyl-acrylate, styrene, polyurethane, polyester, low density polyethylene ("LDPE") beads, polystyrene beads, polymethylmethacrylate ("PMMA") beads, and polyester particles, for example. In particular, the polymer particles can include, but are not limited to, those that are available under the following tradenames: AIRFLEX® (Air Products); ALBERDINGK® (Alberdingk Boley, Inc.); ACRONAL OPTIVE® (BASF Architectural Coatings); NEOCAR® ACRYLIC, UCAR® LATEX, and UCAR® VEHICLE (Dow Union Carbide Chemical Company); JONCRYL® (Johnson Polymers); ARMOREZ®; JONREZ®, and SYNPAQUE® (MeadWestvaco); NEOCRYL® (Neo-Resins); CARBOSET® (Noveon); POLYCHEM® (OPC Polymers); AROLON®, SYNTHEMUL®, and WALLPOL® (Reichhold Chemicals); TEXIGEL (Scott Bader); SETALUX (Akzo Nobel); Rhoplex® and Polyco® (Rohm Haas Chemical), Rovene® (Mallard Creek Polymers, Inc.), Eastman AQ (Eastman Chemical Company); and Witcobond (Witco Chemicals). In one embodiment, the polymer particle is Dow PB6656A, Dow 6688A, Dow 722HS, Dow 756A, or Dow 788A, which are available from Dow Chemical Company.

The swellable binder may be a water-soluble binder including, but not limited to, polyvinyl alcohols polyvinylpyrrolidones, starch or derivatives thereof, gelatin or derivatives thereof, cellulose or derivatives thereof (e.g., cellulose ethers, carboxymethyl cellulose, hydroxyethyl cellulose, or hydroxypropylmethyl cellulose), maleic anhydride polymers or copolymers thereof, acrylic ester copolymers, polyacrylamide, casein, and water- or ammonia-soluble polyacrylates or polymethacrylates and copolymers thereof, quaternary amines, and combinations thereof.

The non-ionic stabilizing surfactants can include, but are not limited to, ethylene oxide propylene oxide block copolymers, alkylphenols, sorbitol ester type compounds, other ether and ester type materials that absorb onto the polymer bead surface, and combinations thereof. In addition, the non-ionic surfactant can include, but is not limited to, alkylphenol ethoxylates, polyoxyethylenates, straight chain alcohols ethoxylates, polyoxyethylenated polyoxypropylene glycols, polyoxyethylenated mercaptans, long chain carboxylic acid esters, glyceryl and polyglyceryl esters of natural and fatty acids, propylene glycol, sorbitol and polyoxyethylenated sorbitol esters, polyoxyethylene glycol esters and polyoxyethylenated fatty acids, alkanolamides, tertiary aceylenic glycols, polyoxyethylenated silicones, N-alkylprrrolidones, alkylpolyglycosides, and combinations thereof.

In particular, the non-ionic stabilizing surfactant can include, but are not limited to, Triton (e.g., 770, ×200, ×100, which is available from Rohm & Haas Co.), Tergitol (e.g., NP 15S series, which are available from Union Carbide), and Igepal (e.g., CO-710 and CA-720, which is available from Rhodia). For example and not intending to be bound by theory, the association of Tritox ×100 with the polymer beads increases the surface tension of Tritox100 solution in the presence of polymer beads over that in water alone.

Figure 3:
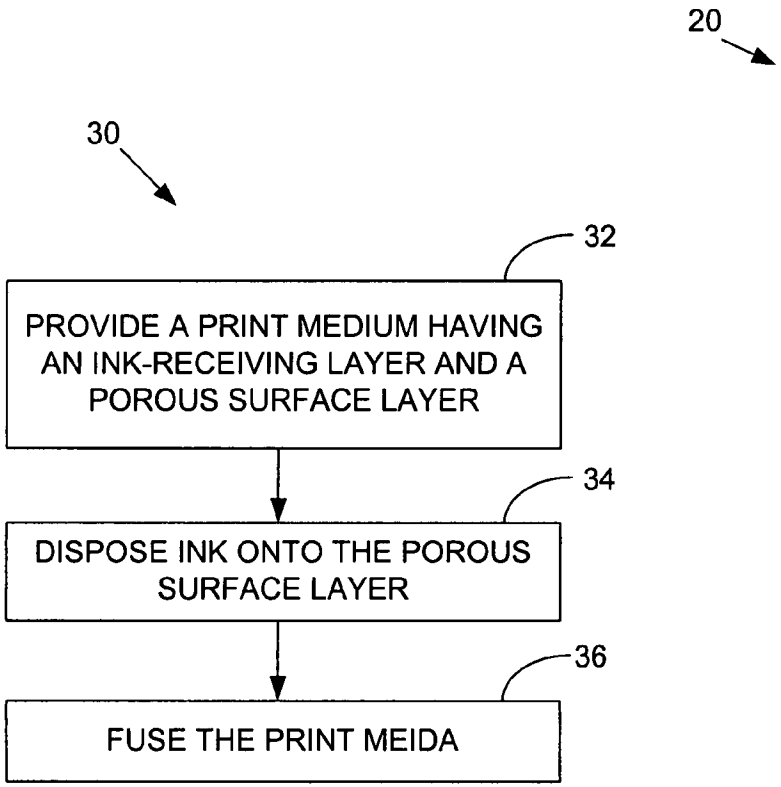
FIG. 3 illustrates a flow diagram of a representative embodiment for using the print medium illustrated in FIG. 2.

FIG. 3 is a flow diagram describing a representative method 30 for printing on a print medium illustrated in FIG. 2 using the printer system 10. In block 32, the print medium having an ink-receiving layer and a porous surface layer is provided. As described above, the porous surface layer includes polymer particles, a swellable binder, and a non-ionic stabilizing surfactant. In block 34, the ink is disposed onto the ink-receiving layer of the print medium using the ink dispensing system 14. In block 36, the print medium is fused by the fuser system 16 after being printed.

The term "fuse," "fusion," "fusing," or the like, refers to the state of a printed character, symbol, and/or image (or the process of obtaining a printed image) that has been at least partially melted such that the porous surface layer forms a film that protects the ink printed therein or thereon. Fusion can occur by applying heat and/or pressure, and preferably both, to the print medium after being printed. Due to the application of heat, and optionally, pressure, the porous surface layer becomes compressed and fused. The amount of heat and/or pressure applied depends, at least in part, on the materials used, but generally, can be from about 90° C. to 250° C. and/or from about 40 pounds per square inch (psi) to 300 psi, respectively.

Figure 4A:
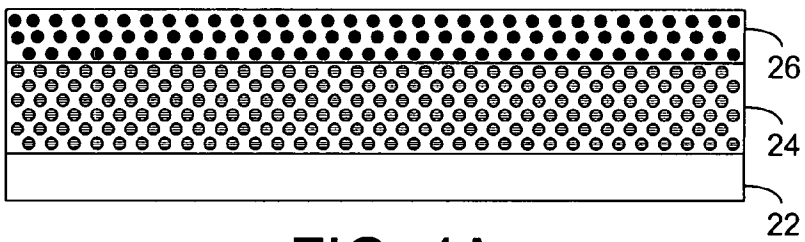
FIGS. 4A through 4C are cross-sectional views of a series of schematic diagrams illustrating the dispensing an ink onto the representative embodiment of the print medium shown in FIG. 2 and the fusing of the print media.
Figure 4B:
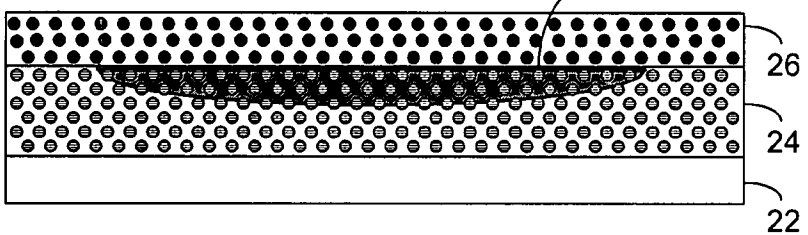
Figure 4C:
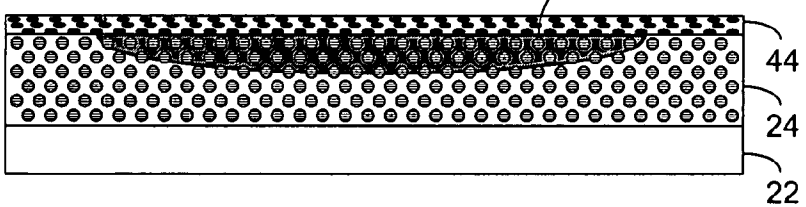

FIGS. 4A through 4C are cross-sectional views of a series of schematic diagrams illustrating dispensing an ink 42 onto the print media 20 shown in FIG. 2 and the fusing of the print media 20. In FIG. 4A illustrates the print media 20, while FIG. 4B illustrates the ink 42 disposed upon the porous surface layer 26 and absorbed into the ink-receiving layer 24. FIG. 4C illustrates the fusing of the fusible print media 20. The porous surface layer 44 has been compressed due to the heat and/or pressure applied by the fuser system 16. The compressed porous surface layer 44 protects the ink 42 printed onto the fusible print media 20.

The ink can include dye-based inks such as, but not limited to, nonionic inks, cationic inks, anionic inks, or mixtures thereof. Black and color dye-based inks for use in ink-jet printing may be employed in the practice of this disclosure. The color inks can include a large number of water-soluble acid and direct dyes as is known by one skilled in the art.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to 5%" should be interpreted to include not only the explicitly recited concentration of about 0.1 wt % to 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

Many variations and modifications may be made to the above-described embodiments. All such modifications and variations are intended to be included herein within the scope of this disclosure and protected by the following claims.

At least the following is claimed:

1. A print medium, comprising:

a substrate;

a porous ink-receiving layer disposed on the substrate, the porous ink-receiving layer including at least one water-soluble polymer and greater than about 80% content of inorganic particles, the at least one water-soluble polymer selected from the group consisting of polyvinyl alcohol, cationic polyvinylalcohol, acetoacetylated polyvinylalcohol, silylated polyvinylalcohol, carboxylated polyvinylalcohol, polyvinylpyrrolidone, copolymer of polyvinylacetate and polyvinylpyrrolidone, copolymer of polyvinylalcohol and polyvinylpyrrolidone, cationic polyvinylpyrrolidone, starch or derivatives thereof, gelatin or derivatives thereof, cellulose or derivatives thereof, maleic anhydride polymers or copolymers thereof, acrylic ester copolymers, polyacrylamide, casein, water- or ammonia-soluble polyacrylates, polymethacrylates and copolymers thereof, and combinations thereof; and a porous surface layer disposed on the porous ink-receiving layer, wherein the porous surface layer includes polymer particles and a non-ionic stabilizing surfactant, the polymer particles having an average particle size ranging from about 100 nanometers to 300 nanometers.

2. The print medium of claim 1, wherein the non-ionic stabilizing surfactant is selected from ethylene oxide propylene oxide block copolymers, alkylphenols, sorbitol ester type compounds, and combinations thereof.

3. The print medium of claim 2, wherein the weight per unit area of the porous surface layer is from about 1 to 3 grams per square meter.

4. The print medium of claim 1, wherein the non-ionic stabilizing surfactant is selected from alkylphenol ethoxylates, polyoxyethylenates, straight chain alcohols ethoxylates, polyoxyethylenated polyoxypropylene glycols, polyoxyethylenated mercaptans, long chain carboxylic acid esters, glyceryl and polyglyceryl esters of natural and fatty acids, propylene glycol, sorbitol and polyoxyethylenated sorbitol esters, polyoxyethylene glycol esters and polyoxyethylenated fatty acids, alkanolamides, tertiary acetylenic glycols, polyoxyethylenated silicones, N-alkylpyrrolidones, alkylpolyglycosides, and combinations thereof.

5. The print medium of claim 1, wherein the porous ink-receiving layer includes microporous, inorganic particles selected from silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudoboehmite, bentonite, hectorite, clay, and mixtures thereof.

6. The print medium of claim 5, wherein the weight per unit area of the porous ink-receiving layer is from about 10 to 30 grams per square meter.

7. The print medium of claim 1, wherein the substrate is selected from a paper substrate, a photobase substrate, and a plastic substrate.

8. The print medium of claim 1, wherein the porous surface layer further includes a swellable binder.

9. A system for preparing a fused ink-jet image, comprising:

a print medium including:

a substrate;

a porous ink-receiving layer disposed on the substrate, the porous ink-receiving layer including at least one water-soluble polymer and greater than about 80% content of inorganic particles, the at least one water-soluble polymer selected from the group consisting of polyvinyl alcohol, cationic polyvinylalcohol, acetoacetylated polyvinylalcohol, silylated polyvinylalcohol, carboxylated polyvinylalcohol, polyvinylpyrrolidone, copolymer of polyvinylacetate and polyvinylpyrrolidone, copolymer of polyvinylalcohol and polyvinylpyrrolidone, cationic polyvinylpyrrolidone, starch or derivatives thereof, gelatin or derivatives thereof, cellulose or derivatives thereof, maleic anhydride polymers or copolymers thereof, acrylic ester copolymers, polyacrylamide, casein, water- or ammonia-soluble polyacrylates, polymethacrylates and copolymers thereof, and combinations thereof; and a porous surface layer disposed on the porous ink-receiving layer, wherein the porous surface layer includes polymer particles and a non-ionic stabilizing surfactant, the polymer particles having an average particle size ranging from about 100 nanometers to 300 nanometers;

an ink dispensing system configured to print ink onto the print medium; and a fuser system configured to fuse the print media after dispensing ink onto the print medium.

10. The system of claim 9, wherein the non-ionic stabilizing surfactant is selected from ethylene oxide propylene oxide block copolymers, alkylphenols, sorbitol ester type compounds, and combinations thereof.

11. The system of claim 9, wherein the weight per unit area of the porous surface layer is from about 1 to 3 grams per square meter.

* * * * *